United States Patent [19]

Moon

[11] Patent Number: 4,994,717

[45] Date of Patent: Feb. 19, 1991

[54] ELECTRONIC STABILIZER FOR A FLUORESCENT LAMP

[75] Inventor: Myoung S. Moon, Seoul, Rep. of Korea

[73] Assignee: Ham Lim Electronic Co., Ltd., Seoul, Rep. of Korea

[21] Appl. No.: 457,718

[22] PCT Filed: Jun. 10, 1988

[86] PCT No.: PCT/KR88/00011

§ 371 Date: Jan. 9, 1990

§ 102(e) Date: Jan. 9, 1990

[87] PCT Pub. No.: WO89/11204

PCT Pub. Date: Nov. 16, 1989

[30] Foreign Application Priority Data

May 13, 1988 [KR] Rep. of Korea ..... 88-5603

[51] Int. Cl.[5] ..... H05B 41/36

[52] U.S. Cl. ..... 315/219; 315/209 R; 315/DIG. 5; 315/DIG. 7

[58] Field of Search ..... 315/209 R, 219, 220, 315/221, 222, 223, 274, 276, 287, DIG. 7, DIG. 5

[56] References Cited

U.S. PATENT DOCUMENTS 4,045,711 8/1977 Pitel ..... 315/209 R
4,424,468 1/1984 Zelina et al. ..... 315/222

FOREIGN PATENT DOCUMENTS

WO89/11204 11/1989 PCT Int'l Appl. .

OTHER PUBLICATIONS

International Search Report conducted by the Austrian Patent Office and completed on Dec. 21, 1988 citing 4 prior art references.

*Primary Examiner*—Eugene R. Laroche
*Assistant Examiner*—Ali Neyzari
*Attorney, Agent, or Firm*—Staas & Halsey

[57] ABSTRACT

An electronic stabilizer for a fluorescent lamp characterized by comprising noise filter, voltage multiplying rectifier, inverter with the first and second register, first and second high speed starter in the inverter, and input trigger connected with the commercial power source to provide inexpensive, simple, and stable electronic stabilizer by the limited current and better practice at oscillating high frequency.

3 Claims, 3 Drawing Sheets

ELECTRONIC STABILIZER FOR A FLUORESCENT LAMP

FIELD OF THE INVENTION

This invention relates to the electronic stabilizer for a fluorescent lamp, more particularly relates to the method for manufacturing same in a simple circuit type, wherein the starter circuit becomes the magnetic inverter oscillator connected with D.C. power source, thereby the first and the second limiter are located between fluorescent lamp and magnetically oscillating inverter.

BACKGROUND-REFERENCE TO RELATED APPLICATIONS

This invention is related to the prior arts of Korean Patent Serial No. 81-566, Korean Patent Serial No. 81-142 corresponding with British Patent No. 2071905, and Korean Patent Serial No. 82-1748.

The circuit diagrams for the above-referenced applications are illustrated in FIG. 1 A,B,C. These electronic starter circuits for a fluorescent lamp include; inverter-circuit comprising two transistors Q1, Q2 connected serially to D.C. power source; current transformer To for maintaining the oscillation operation of the transistors Q1, Q2; series resonance circuit comprising the inductor Lo and the capacitor C connected to the node point of two transistors Q1, Q2; and other capacitors connected to the both sides of series resonance circuit and the voltage source. In the prior arts shown in FIG. 1, there are, however, absurdity in circuit operation and impracticality in use, as discussed below.

The inverter circuit connected with the D.C. power source (Korean patent Serial No. 81-566) is given to series resonance of capacitor C passed by the inductor Lo which has the oscillating conditions of the current transformer To and current transistors Q1, Q2 at the time of lighting. Therefore, the time of the said transistors Q1, Q2 for turn-ON/OFF of the said transistors Q1. Q2 is disagreeded due to the high frequency noise of fluorescent lamp, and the overheat of said transistors Q1 Q2 are generated due to the simultaneous situation of "turn-ON". It is suggested that the auxilliary transistors A2, A8 described in FIG. 1 B of the prior art (Korean Patent Serial No. 81-1421) should be accomodated in the base of the main transistors A1, A7.

The said circuits (Korean patent Serial No. 81-566) have unresonable system of the trigger for the initial oscillating of the inverter circuit, impossibility of the initial oscillating of the load of discharge lamp as a fluorescent lamp due to using for a long time, and continuous maintenance of its oscillation due to the damage of the fluorescent lamp. Therefore, it is hardly expected in safety for users and for circuit components, suggesting that the prior art, described in FIG. 1 C (Korean Patent Serial No. 82-1748) regarding the seperate use of the protection circuit and trigger diode D29 should be prepared for solving these problems.

In comprising the circuits satisfying all the conditions mentioned earlier, the difficulty will follow from the increased number of circuit, complicated circuit, high cost at manufacturing, and the generation of heat in circuit. Also, the design of the circuit for the induction load and the high-frequency circuit is difficult due to the characteristics of circuit part itself or the change of the input in the electronic starter circuit of the former fluorescent lamp using the capacitor C. Consequently, the generation of heat and the reduction of reliance for the circuit itself are arised from these reasons. Therefore, the better radiation system of the said transistors Q1, Q2 and inductor Lo should be prepared for solving these problems. Particulary, the unchanged conditions in high frequency intervening between the inverter circuit and the induction load should be prepared for these reasons. However, there are still the problems of confidence, effectiveness, and defects of noise by the circuit characteristics of the induction load and high frequency, as there is nothing better solution for the said problems.

The object of the present invention is to provide the inexpensive and simple electronic stabilizer for a fluorescent lamp which could reduce all the problems mentioned earlier. Another object of the present invention is to provide simpler electronic stabilizer for a fluorescent lamp which could provide the limitted current and better practice to the electronic stabilizer at oscillating high-frequency. Another object of the present invention is to provide the simple electronic stabilizer for the lower cost and the stable circuit.

The electronic stabilizer mentioned in the said present invention is characterized by comprising noise filter, voltage multiplying rectifier, inverter with the first and second register, the first and second high-speed switching in the inverter, and input trigger connected with commercial power source. Further objects and advantages of the present invention will be discussed in details with the reference to the drawings

DESCRIPTION OF THE INVENTION

Figure 1:
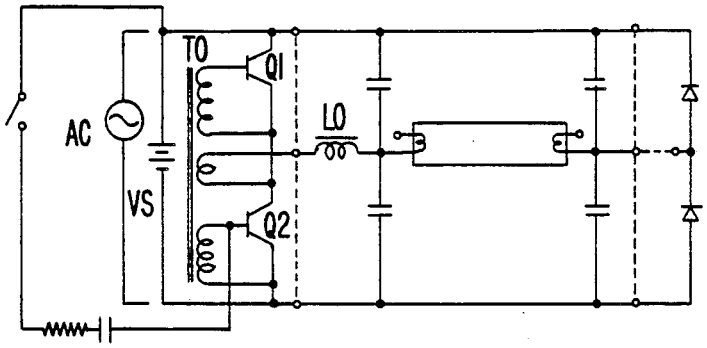
FIG. 1 (A) (PRIOR ART)
FIG. 1 A, B, C are the views of the circuit in the conventional electronic stabilizer for the fluorescent lamp.
Figure 1:
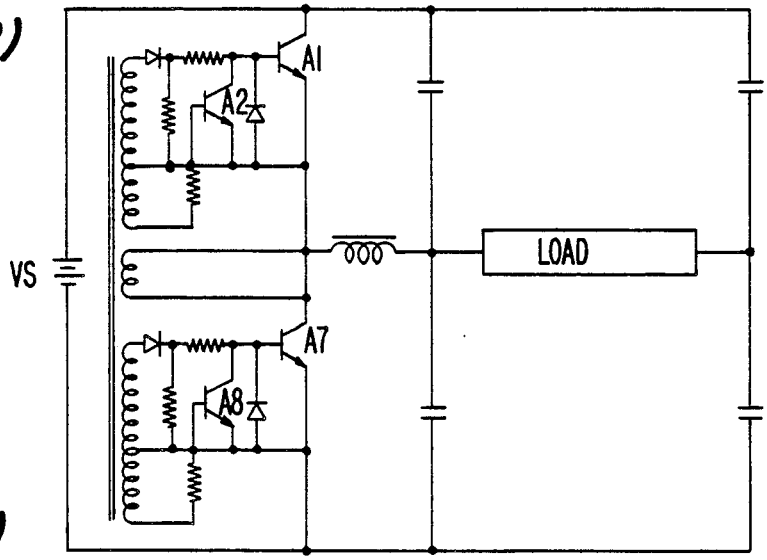
FIG. 1 (B) (PRIOR ART)
Figure 1:
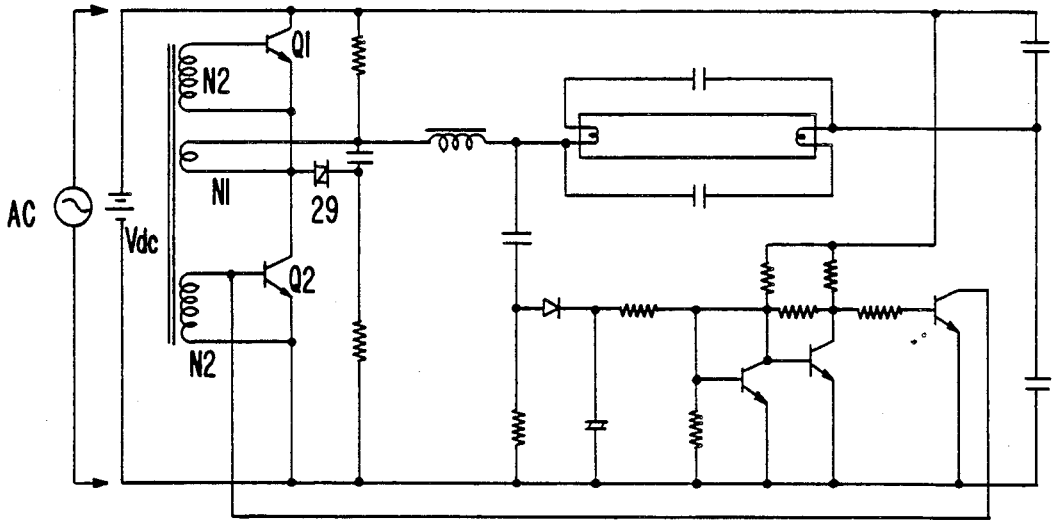
Figure 2A:
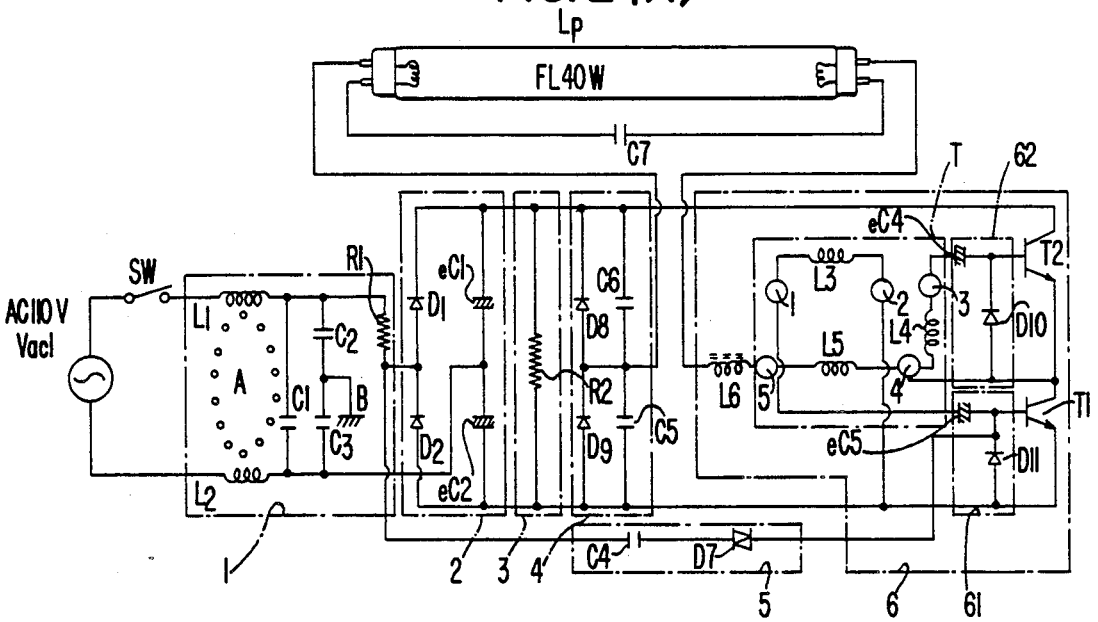
FIG. 2 A, B are the detailed views of the circuit in the electronic stabilizer for a fluorescent lamp according to the present invention.
Figure 2B:
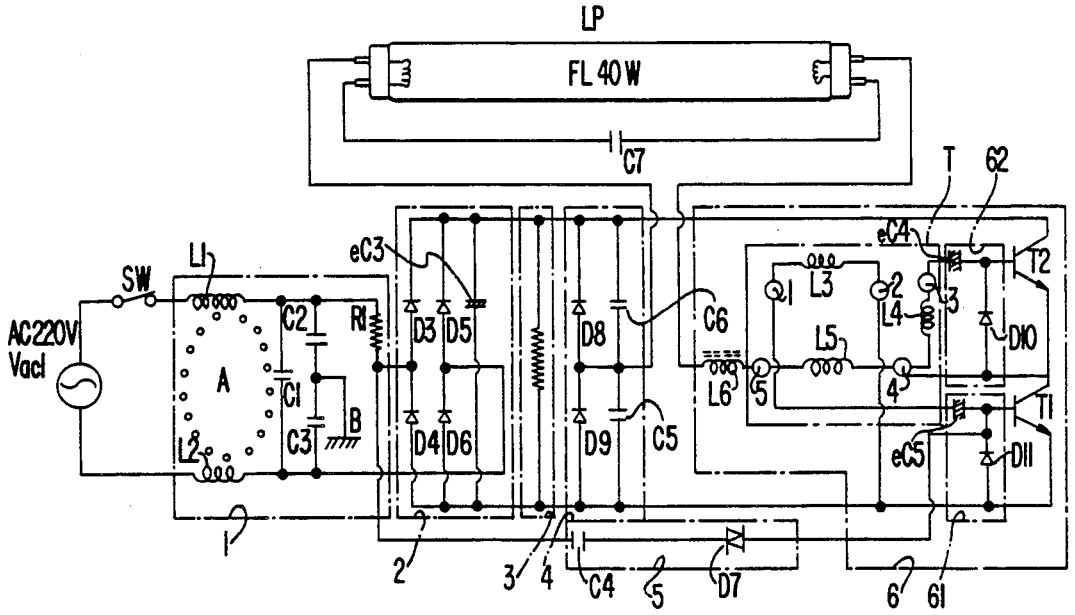

FIG. 2 illustrates an preferred embodiment of the circuit constitution in stabilizer according to the present invention. As best seen in FIG. 2 A, noise filter 1 linked to A.C. voltage power source, voltage multiplying rectifier 2 (possible change in accordance with a commercial voltage source), and inverter 6 are contacted orderly in parallel. The trigger input of said inverter 6 includes also a capacitor C4 and diac D7 of the input trigger 5 which is connected in series with commercial voltage source. Therefore, trigger input of the inverter 6 is provided.

The noise filter 1 includes resistance R1, inductance L1, L2, and capacitors C1, C2, C3. The output of the noise filter 1, as illustrated in FIG. 2 A, is connected to the A.C. 110 V voltage multiplying rectifier 2 comprising two diodes D1, D2 and electrolytic condensers eC1. eC2., or it is connected to A.C. 220 V voltage multiplying rectifier 2' comprising an electrolytic condenser eC3 and four diodes D3, D4, D5, D6 which operate as bridge circuit. Therefore, the commercial A.C. input source passed through the said voltage multiplying rectifier 2 becomes 2Vac 1. The output of the voltage multiplying rectifiers 2, 2' is connected to the first current limiters 3, 3' composing of resistance R2, R3. The output of the first current limiter 3, 3' is contacted in parallel with the second current limiter 4 linked to one side of the fluorescent lamp. When the transistors T1, T2 of the inverter 6 are switched "ON or OFF", the second current limiter 4 are connected in parallel with the resonance limiting capacitors C5, C6 and counter electromotive force cut-off diode D8, D9 toward a fluorescent lamp.

Two transistors T1, T2 in the inverter are connected in series. Each input of the transistors T1, T2 is connected to the first, second high speed switches 61, 62 comprising diodes D10, D11 and two electrolytic condensers eC4, eC5. The above electrolytic condensers eC4, eC5 are, then, connected to the first coils L3, L4 of high frequency current transformer each linked in series. The second coil L5 in the current transformer T is connected to the inductor which has serial connection with the another side edge of the fluorescent lamp. The another side of the filament in the fluorescent lamp is contacted to the operating capacitor C7 at the opened position in parallel.

Figure 3:
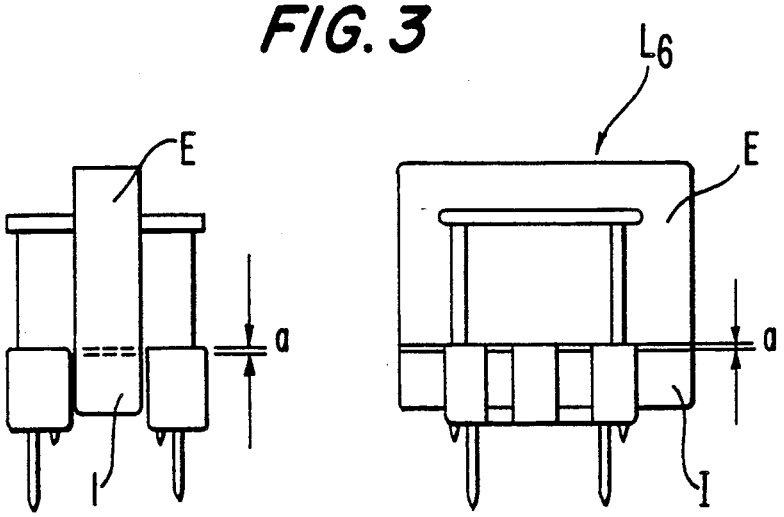
FIG. 3 is the view of the inductor shown in FIG. 2 according to the present invention.

Furthermore, as illustrated in FIG. 3, the said inductor L6 consists of transformer becoming the EI (Electric magnetic Induction) core type, when the first and second coil in the EI core are joined together as usual manner, the gap (a) in the EI core is about 0.5 mm to 1 mm.

Figure 4:
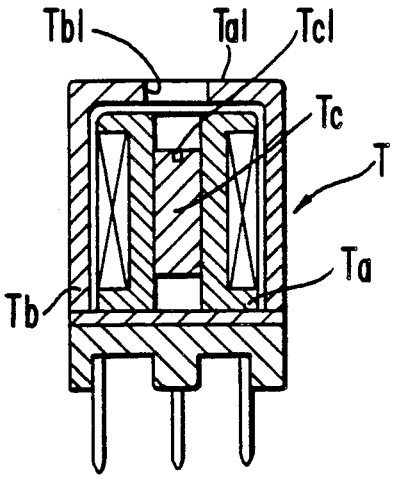
FIG. 4 is the view of the current transformer shown in FIG. 2 according to the present invention.
Figure 5:
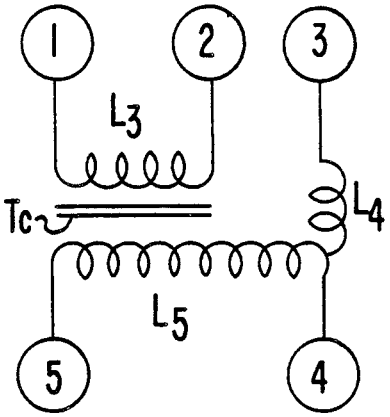
FIG. 5 is the view of the equivalent circuit of current transformer shown in FIG. 4 according to the present invention.

FIG. 4 and 5 are perspective view and an equivalent circuit of the current transformer illustrated in FIG. 2, respectively. In the current transformer T as shown in FIG. 4, coil bobbin Ta of synthetic resin having central opening Tal is set up inwardly to the inside of the outer case Tb having a groove at the cylindrical center, and the core Tc is inserted into the central opening Tal. As shown in FIG. 5, the above core, which has a cross-groove Tcl on the top and cylindrical surface with the male screw, is screw-jointed with coil bobbin of the female at the inside of central opening Tal. The equivalent circuit of the above current transformer T is arranged like the circuit.

The operations of the electronic stabilizer according to the present invention are described in details below. When the power switch SW is switched "ON", and commercial input Vac 1 passes, then, through the noise filter 1, the input is double-up, i.e. 2Vac 1, at the voltage multiplying rectifier 2, and the double-up input, 2Vac 1, transmits to the inverter 6.

In the input trigger 5, the trigger pulse is, then generated by the capacitor C4 and the diac D7 simultaneously as the half wave is inputted by the sinusoidal cycle of the commercial power source.

Due to the above trigger pulse, one transistor T1 is "ON" state, and the other transistor T2 is "OFF" state in the inverter 6, and both these transistors T1, T2 are running over again by the inductor L6 and capacitor C7 under the resonance mechanism.

Before starting a fluorescent lamp, the inverter 6 transmits a power voltage to the inductor L6 as the transistor T2 is "turn-ON", and begins to charge a capacitor C7 which is connected to the fluorescent lamp in parallel.

Only one transistor becomes "turn-ON" state at a certain moment as the role of the current transformer T. Higher voltage is, then, gradually discharged to the capacitor C7 according the resonance mechanism of said inductor L6 and said capacitor C7, and finally, the fluorescent lamp begins to light as getting to the discharge-start voltage.

In said transistors T1, T2 base, each "turn-ON" and "turn-OFF" of the transistors T1, T2 are started promptly at high speed to the first and the second high-speed starters 61, 62 with a role of the first coil in the current transformer T at this time. Therefore, said transistors T1, T2 are not happened to be "turn-ON" state simultaneously.

After starting the said fluorescent lamp, the current transmitted to the fluorescent lamp is controlled effectively by the second current limiter 4 when each of the transistors T1, T2 is in "turn-ON" or "turn-OFF" position separately. That is, the inflow toward the voltage source is stopped and controlled by the counter electromotive force with high-frequency, thereby the security of the circuit is achieved. Moreover, the second current limiter 4, as the two capacitors C5, C6, continues to discharge at low voltage by decreasing the resonance coefficient of the resonance circuit with the own resistance for the fluorescent lamp.

The stability of operating condition is also maintained by limiting the total over-current of the circuit in the first current limiters 3, 3'. On excluding or breaking the lamp, the oscillation circuit including the inverter 6 is automatically stopped by the "opening" state of the capacitor C7 in cooperation with the inverter 6 switching.

When the inverter switching is stopped by unrespected condition, normal A.C. power source will be put in the input trigger 5. Therefore, the oscillating operation can not be stopped by always giving the starting condition of switching in the inverter, as far as connectiong the lamp. In the FIG. 3, the gap of core between E and I of the inductor L6 will be enlarged, relatively. Therefore, the organic energy can be appropriately stored, and the oscillating condition can be in the better conditions. Also, as shown in FIG. 4, the current transformer T will increase and decrease the organic energy using the screw Tcl formed on the top of the core Tc. Therefore, the current transformer T can compensate for the error of the frequency caused by the change of input.

In the present invention, the input trigger 5 is connected in series with the noise filter 1, the voltage multiplying rectifier 2, and the said input of inverter 6, and the high-speed starters 61, 62 making the action for ON/OFF of the transistors T1, T2 rapid is accomodated in the input of transistors T1, T2 of the said inverter 6. Also, in the present invention, the electronic stabilizer which is inexpensive in cost, safe in use, and simple and confident in circuit will be offered by operating the resonance condition between the starting capacitors C7 and the current limiters 3, 4.

We claim:

1. The electronic stabilizer for a fluorescent lamp characterized by the composition connected between the resonance circuit including inductor L6 and inverter 6 in accordance with the transistors T1, T2 and the current transformer T comprising: the first coils L3, L4 of the variable current transformer T, the first, and second high-speed starters 61, 62 with the electrolytic condensers eC4, eC5 and two diodes D10, D11, each connected to the input of the first, and second transistors T1, T2 in the said inverter 6; the first current limiters 3, 3' and the second current limiter 4 connected among the inverter 6, direct power source, and one side of filament in the fluorescent lamp; the input trigger 5 connected between the input of the first transistor T1 and the commercial power source in the inverter 6; the filament of one side of the fluorescent lamp Lp connected to the output of said inverter 6 through inductor L6; the capacitor C7 connected to the opening part of filament in said fluorescent lamp Lp in parallel.

2. The electronic stabilizer for a fluorescent lamp as set forth in claim 1, wherein said inductor L6 becomes transformer comprising EI core, and the gap of said EI core is about 0.5 mm to 1 mm.

3. The electronic stabilizer for a fluorescent lamp as set forth in claim 1, wherein said variable current transformer T varies the mutual organic energy between the first coils L3, L4 and the second coil L5 utilizing core Tc in the inside of core bobbin Ta of synthetic resin.

* * * * *